United States Patent [19]

Kuwashima et al.

[11] 3,990,230

[45] Nov. 9, 1976

[54] METHOD FOR CONTROLLING STEAM TURBINE AND DEVICE THEREFOR IN COMPOSITE PLANT EQUIPPED WITH STEAM TURBINE AND GAS TURBINE

[75] Inventors: Hidesumi Kuwashima, Hitachi; Ryosuke Arie, Katsuta, both of Japan

[73] Assignee: Hitachi, Ltd., Japan

[22] Filed: Nov. 15, 1974

[21] Appl. No.: 524,266

[30] Foreign Application Priority Data

| | | |
|---|---|---|
| Nov. 16, 1973 | Japan | 48-128343 |
| Nov. 26, 1973 | Japan | 48-131674 |
| Jan. 30, 1974 | Japan | 49-11825 |
| Aug. 28, 1974 | Japan | 49-97828 |

[52] U.S. Cl. ..... 60/39.18 B; 60/39.03; 415/17

[51] Int. Cl.[2] ..... F02C 7/02

[58] Field of Search ..... 60/39.18 B; 415/17

[56] References Cited

UNITED STATES PATENTS

| | | | |
|---|---|---|---|
| 2,095,860 | 10/1937 | Ericson | 415/17 |
| 2,098,803 | 11/1937 | Harris | 415/17 |
| 2,111,420 | 3/1938 | Ericson | 415/17 |
| 3,325,992 | 6/1967 | Sheldon | 60/39.18 B |
| 3,342,195 | 9/1967 | Wagner | 415/17 |
| 3,603,695 | 9/1971 | Yokota | 415/17 |
| 3,669,559 | 6/1972 | Sakamoto | 415/17 |

*Primary Examiner*—Clarence R. Gordon
*Attorney, Agent, or Firm*—Craig & Antonelli

[57] ABSTRACT

In a plant of a composite cycle which includes a steam turbine having a high pressure portion and a low pressure portion, a gas turbine, and a waste heat boiler having heat exchangers producing high pressure steam and low pressure steam to be fed to the steam turbine, by the use of exhaust gas from the gas turbine as a heat source; there are provided steam valves on steam passages through which steam is fed from the heat exchangers of waste heat boiler to the steam turbine; a detecting device for detecting the condition of steam flowing into the steam valve; and another detecting device for detecting the r.p.m. of the steam turbine; whereby the opening and closing of the steam valves are controlled by means of a selecting device which preferentially selects either of signals from the aforesaid detecting devices to adjust the quantity of steam to be fed to the steam turbine for controlling the steam turbine.

8 Claims, 5 Drawing Figures

METHOD FOR CONTROLLING STEAM TURBINE AND DEVICE THEREFOR IN COMPOSITE PLANT EQUIPPED WITH STEAM TURBINE AND GAS TURBINE

BACKGROUND OF THE INVENTION

This invention relates to a composite plant including a gas turbine and a steam turbine in combination, and more particularly to the control of a steam turbine by adjusting a quantity of steam to be fed to the steam turbine.

Hitherto, in a composite plant including, in combination, a steam turbine, a gas turbine, and a waste heat boiler producing the steam serving as an operating fluid for the steam turbine by using exhaust gas from the gas turbine as a heat source, the opening of a steam regulating valve for use in adjusting high pressure steam to be fed to the steam turbine has been controlled by resorting to a speed signal of the steam turbine, which has been detected by a governor equipped for the steam turbine. In such a method, however, if there arises fluctuation in pressure of the steam from the waste heat boiler, the change in r.p.m. of the steam turbine takes place after the flow rate of the steam produced has changed. Thus, there is a time lag of a considerable extent from the time when the change in steam pressure takes place until the regulating valve is conrolled by the governor, thus leading to unsatisfactory controlling for the steam turbine.

Where there are provided in the waste heat boiler two heat exchangers producing high pressure steam and low pressure steam, then high pressure steam produced in the heat exchanger of the high pressure side is introduced through a regulating valve or a steam valve into the high pressure portion of steam turbine, while low pressure steam produced in the heat exchanger on the low pressure side is introduced through an injection valve i.e. a steam valve into the low pressure portion of the steam turbine. The injection valve, likewise the regulating valve, effects a speed control with the aid of the governor, with its opening maintained in the fully opened position, during the running of the steam turbine. However, there frequently arises fluctuation in temperature of exhaust gas coming from the gas turbine into the waste heat boiler, due to variation in the load exerted on the gas turbine or due to variation in the ambient temperature in the composite plant. This leads to change in a steam condition, i.e. steam pressure, of the steam to be introduced into the low pressure portion of the steam turbine from the heat exchanger on the low pressure side of the waste heat boiler, resulting in the failure to control the running of the steam turbine. In other words, because the injection valve merely serves as an overspeed preventive valve when the steam turbine is in the normal running, there has been experienced that, depending upon change in pressure of the low pressure steam produced in the heat exchanger on the low pressure side in the waste heat boiler, pressure of the low pressure steam becomes higher than the pressure of the operating steam flowing from the high pressure portion of the steam turbine towards the low pressure portion thereof, and as a result, the steam streams within the steam turbine are reversed to cause the steam to flow from the low pressure portion to the high pressure portion in the steam turbine, leading to a serious trouble in the steam turbine.

SUMMARY OF THE INVENTION

It is accordingly an object of the present invention to provide a method for controlling a steam turbine, wherein a condition of steam produced in a waste heat boiler by utilizing exhaust gas from a gas turbine and introduced into the steam turbine is controlled in a manner to be suited for a condition of steam streaming within the steam turbine.

Another object of the present invention is to provide a method for controlling a steam turbine, wherein a quantity of steam to be fed to the steam turbine from a waste heat boiler, in which steam is produced by utilizing exhaust gas from a gas turbine, is controlled according to a speed of the steam turbine and the condition of steam thus fed to the steam turbine.

A further object of the present invention is to provide a device for controlling a steam turbine, which controls the quantity of steam to be fed to the steam turbine, from a waste heat boiler, in which steam is produced by utilizing exhaust gas from a gas turbine, according to the speed of the steam turbine and pressure of steam thus fed to the steam turbine, and which is superior in a controlling characteristic.

A still further object of the present invention is to provide a method for controlling a steam turbine, wherein in a composite plant including a steam turbine, a gas turbine and a waste heat boiler producing steam serving as an operating fluid for the steam turbine, by the use of exhaust gas from the gas turbine as heat source, steam to be fed from a mid stage of the steam turbine is adjusted so as to be suited for the condition of an operating steam introduced into the steam turbine from a high pressure stage of the steam turbine, thereby facilitating control of the running of the composite plant.

DETAILED DESCRIPTION OF THE INVENTION

Figure 1:
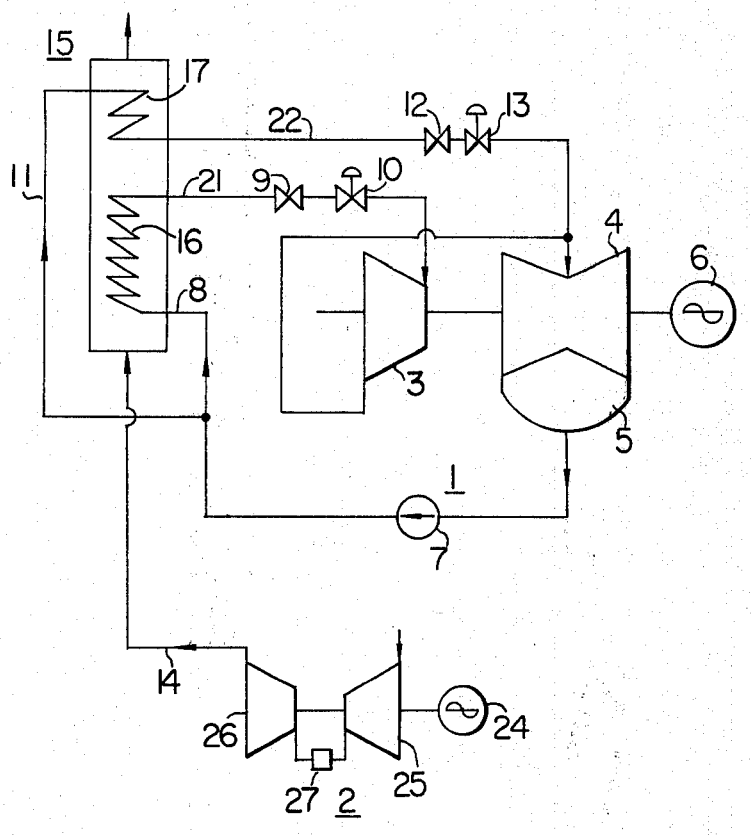
FIG. 1 is a schematic view showing the outline of a composite plant including a steam turbine and a gas turbine to which the present invention is applied.

Referring to FIG. 1 showing a composite cycle of a plant including a steam turbine 1, a gas turbine 2 and a waste heat boiler 15 in combination, air compressed by a compressor 25 in a gas turbine plant 2 is mixed with fuel 27 to given a combustion gas, and a gas turbine 26 is driven by the combustion gas, whereby power is generated by a generator 24. High temperature exhaust gas from the gas turbine 26 is introduced by way of an exhaust gas passage 14 into a waste heat boiler 15. The waste heat boiler 15 involves therein a high temperature heater 16 producing steam of high temperature and high pressure, and a low temperature heater 17 producing steam of a low temperature and low pressure, as compared with the steam produced in the high temperature heater. The high temperature heater 16 is located on the upstream side of the exhaust gas path 14 leading from the gas turbine to the waste heat boiler, with respect to the low temperature heater 17, so that heat energy may be effectively utilized. The steam produced in the high temperature heater 16 is admitted by way of a piping 21 and through a main steam stop valve 9 and a steam regulating valve 10 into a high pressure turbine 3 of the steam turbine 1. Since, in the waste heat boiler 15, exhaust gas from the gas turbine 2 is utilized for producing steam, there arises fluctuation in pressure of the steam produced in the high temperature heater 16. Thus, the steam flowing by way of the piping 21 into the high pressure turbine 3 is subjected not only to a speed control by the steam regulating valve 10 according to a conventional governor, but also to a pressure control to cope with the variation in pressure of steam produced in the high temperature heater 16. The steam from the high pressure turbine 3 is admitted into a low pressure turbine 4. On the other hand, the steam produced in the low temperature heater 17 flows by way of a piping 22, then through a steam injection stop valve 12 and a steam injection valve 13 provided on the piping 22 and into a low pressure turbine 4 of steam turbine 1. At this time, since the steam from the low temperature heater 17 is mixed with the steam coming from the high pressure turbine 3 to stream into the low pressure turbine 4, it is imperative that the steam coming through the steam injection valve 13 be maintained in the same pressure level as the steam coming from the high pressure turbine 3. If pressure of the steam coming through the steam injection valve 13 is lower than that of the steam coming from the high pressure turbine 3, then the steam from the high pressure turbine 3 will not be introduced into the low pressure turbine 4 but led to the piping 22. On the contrary, if pressure of the steam from the steam injection valve 13 is higher than that of the steam from the high pressure turbine 3, then, the steam from the injection valve will flow into the high pressure turbine 3. For this reason, the steam injection valve 13, other than being subjected to a speer control by the governor, is so controlled that pressure of steam produced in the low temperature heater 17 is detected as a signal, and according to the pressure signal thus detected, pressure in the valve is usually maintained constant.

The steam introduced into the low pressure turbine 4 is subjected to cooling by a steam condenser 5 and turned into water, and the water is fed by way of a water supply pipe 8 into the high temperature heater 16, then by way of a water supply pipe 11 into the low temperature heater 17, by the operation of a water supply pump 7. The generator 6 is driven by the high pressure turbine 4.

The steam regulating valve 10 and steam injection valve 13 are controlled by a speed signal from the governor and a pressure signal from the steam pressure detector. In the actual control, a signal more largely influencing the turbine is preferentially selected from both signals, for being controlled. In this connection, a controlling device equipped with preference mechanisms for preferentially selecting one signal from both signals will be referred to, in conjunction with FIGS. 2 and 3.

Figure 2:
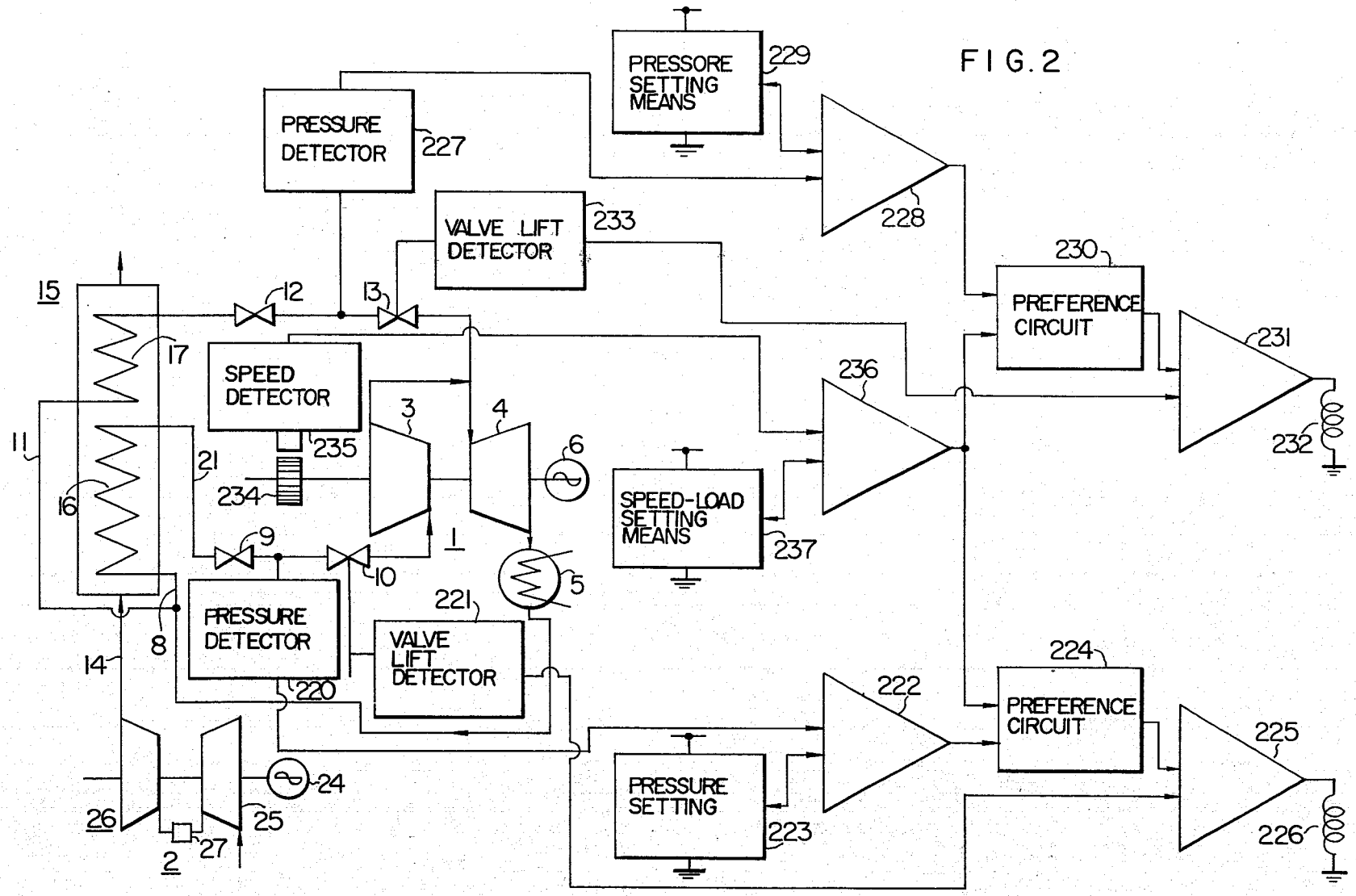
FIG. 2 is a block diagram showing a device for controlling a steam turbine in the composite plant of FIG. 1, according to an embodiment of the present invention.
Figure 3:
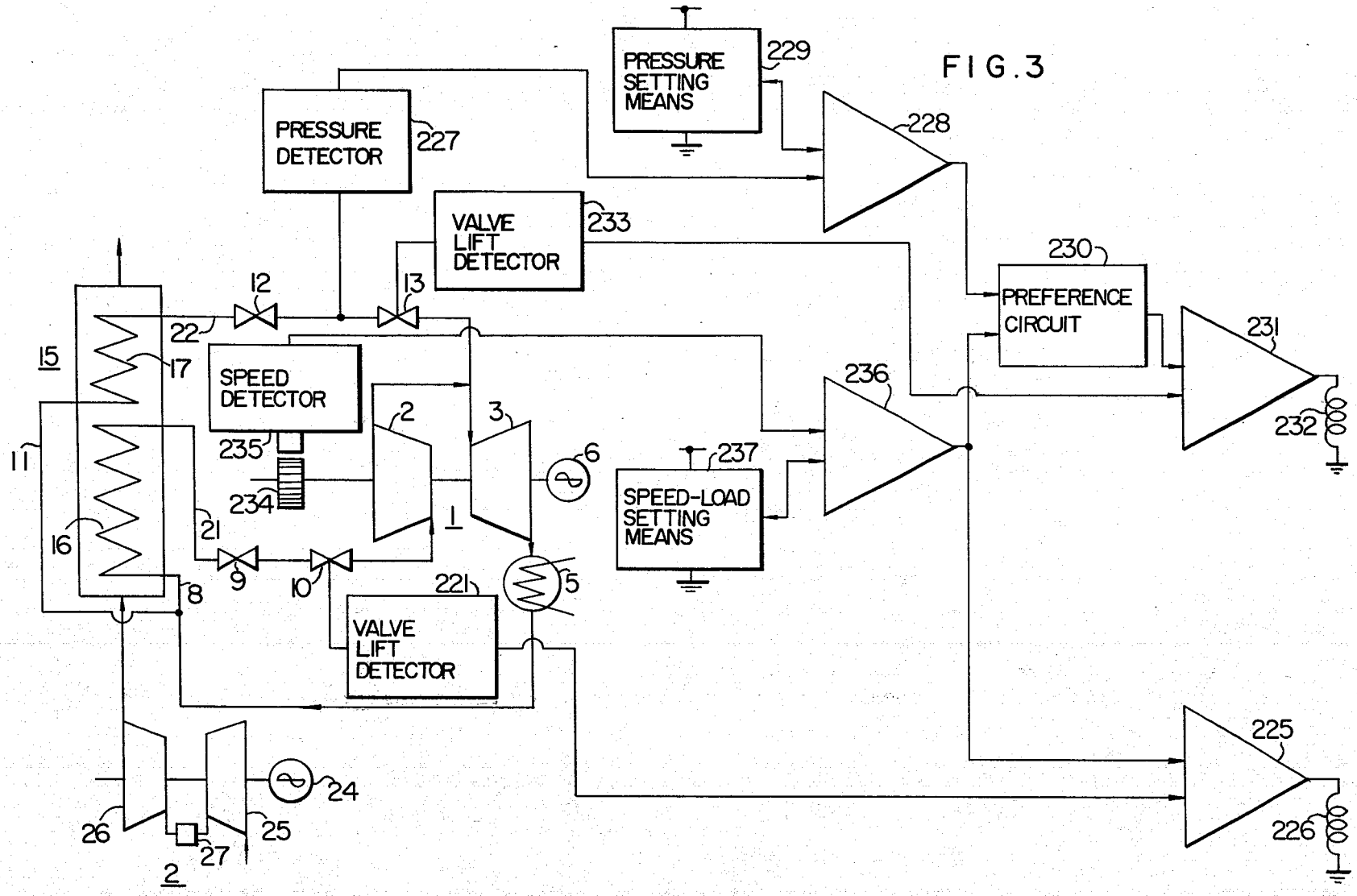
FIG. 3 is a block diagram showing a device for controlling a steam turbine in the composite plant, which is a modification of FIG. 2.

FIGS. 2 and 3 show a block diagram of an electric system controlling device for a steam turbine in a composite turbine plant. In the controlling device shown in FIG. 2, a rotating speed of the steam turbine 1 is electrically detected by a gear 234 on a turbine shaft and a speed detector 235, and an output from the speed detector 235 is added to a servo-amplifier 236, so that the output may be compared with voltage in speed-load setting means 237, whereby an amplified speed deviation signal is obtained. A pressure detector 227 is provided in the mid portion between the valves 12 and 13 to detect a steam pressure on the upstream side of the injection valve 13 for use in the low pressure turbine, and the output from the pressure detector 227 is fed to a servo-amplifier 228, for being compared with a set value of pressure setting means 229, so that a pressure deviation signal may be produced. The speed deviation signal and pressure deviation signal are fed to a preference circuit 230 for use in controlling the injection valve. The preference circuit 230 is so designed as to compare both deviation signals with each other, thereby selecting, as an output signal, either one of the aforesaid both signals, i.e., a signal to protect the steam turbine, that is a signal of low level which requires a less degree of opening of the injection valve 13 for actuating the valve in a direction closing same. In the servo-amplifier 231, the signal is compared with an output signal fed from a valve lift detector 233 of the injection valve 13, thereby actuating as an error voltage a hydraulic servo valve 232, whereby the injection valve 13 is opened or closed in a manner to cancel the output deviation signal from the preference circuit.

Meanwhile, pressure on the upstream side of the steam regulating valve 10 is detected by a pressure detector 220 and then fed to a servo-amplifier 222. In the servo-amplifier, the signal thus detected is compared with a set value in pressure setting means 223, whereby a pressure deviation signal is obtained. The pressure deviation signal is fed to a regulating valve controlling preference circuit 224, together with the aforesaid speed deviation signal. In the regulating valve controlling preference circuit 24, a signal protecting the turbine, i.e. a signal of low level which requires a less degree of opening of the regulating valve, is selected from both deviation signals to be taken out as an output. The signal is compared with a detecting signal produced from a regulating valve lift detector 221, in a servo-amplifier 225, so that a servo valve 226 is actuated due to a deviation signal thus obtained, whereby the regulating valve 10 is opened or closed in a manner to cancel the output deviation signal in the regulating valve controlling preference circuit 224.

In short, the controlling device is so constructed that both the speed of the steam turbine 1 and the steam pressure in a portion before the regulating valve and injection valve are electrically detected for comparison with respective set values, and if a speed of the steam turbine is more than a set value, then the injection valve and regulating valve are closed to drop the turbine speed, while in the event that the steam pressure is increased, the regulating valve and injection valve are opened to increase an output of the steam turbine as well as to prevent rise in the steam pressure in the boiler.

Thus, at the time of starting of the plant or a large fluctuation in load, the steam turbine is controlled only by the use of a speed signal, with the pressure system being given a bias signals, at the time of normal running, if the pressure system is set in a manner to be operated by a speed signal of more than a certain value, control for the steam turbine is effected by controlling the steam pressure only.

To provide the preference circuit on the side of the regulating valve is advantageous in the point of improving responsiveness of the regulating valve with respect to a pressure change in the steam to be fed to the high pressure portion of steam turbine.

The controlling device for use in a composite plant shown in a block diagram of FIG. 3 is nearly the same as the controlling device shown in FIG. 2, with the exception that there are omitted the regulating valve controlling preference circuit 224 operating the regulating valve 10, the pressure detector 220 transmitting a pressure signal to the preference circuit 224, and the servo-amplifier 222. In the controlling device shown in FIG. 3, a steam pressure on the upstream side of the regulating valve 10 is not detected, but only a speed error signal voltage in the steam turbine produced from the servo-amplifier 236 is introduced into the servo-amplifier 225. The signal voltage is compared with a signal from the valve lift detector 221 detecting a degree of opening of the steam pressure regulating valve 10. The error signal voltage is amplified to operate the servo valve 226. Thus, the regulating valve 10 is operated to change an output voltage in the valve lift detector 221, whereby an output in the servo-amplifier 225 becomes null.

As is apparent from the foregoing, if a speed of the steam turbine becomes more than a set value, the regulating valve is closed, and when the speed exceeds a certain value, the injection valve is closed as well. Meanwhile, the injection valve is rendered open, with increase in the steam pressure, and rendered close when the steam pressure decreases. When in the starting of the plant or when a large fluctuation in load takes place, a speed control is effective, and when in the normal running, a pressure control is useful. Thus, according to the present invention, both the speed and pressure are detected, so that the steam turbine may be run with the assurance of protection of the turbine itself.

In the controlling device according to the second embodiment, there is no preference circuit on the side of the regulating valve. This is due to the fact that even if pressure in the regulating valve is not controlled, a controlling characteristic in the composite plant is not so much impaired.

Figure 4:
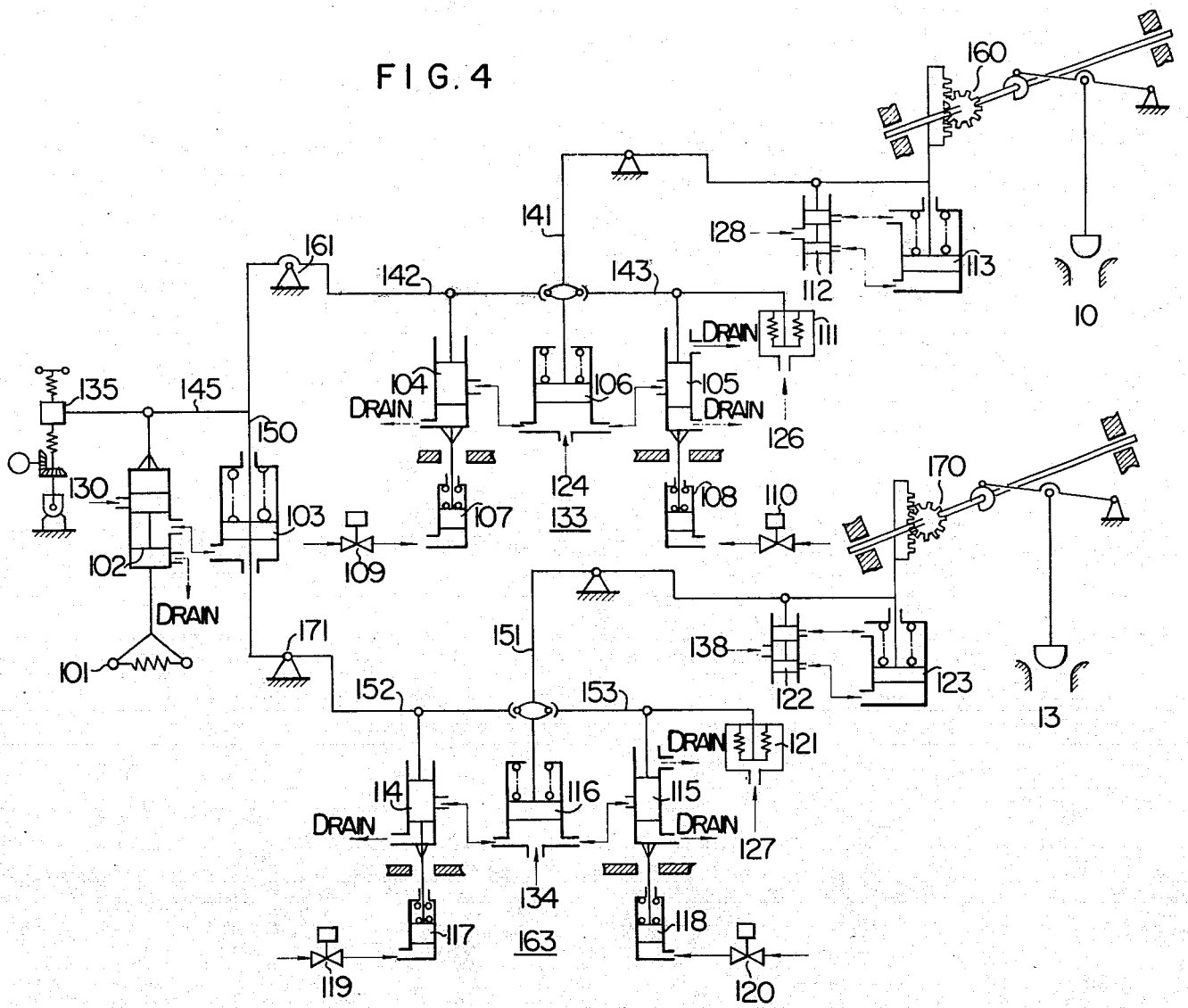
FIG. 4 is a block diagram showing a steam turbine controlling device of a mechanical system in the composite plant of FIG. 1, according to a further embodiment; and, FIG. 5 is a block diagram showing a steam turbine controlling device of a mechanical system in the composite plant, according to a modification of FIG. 4.
Figure 5:
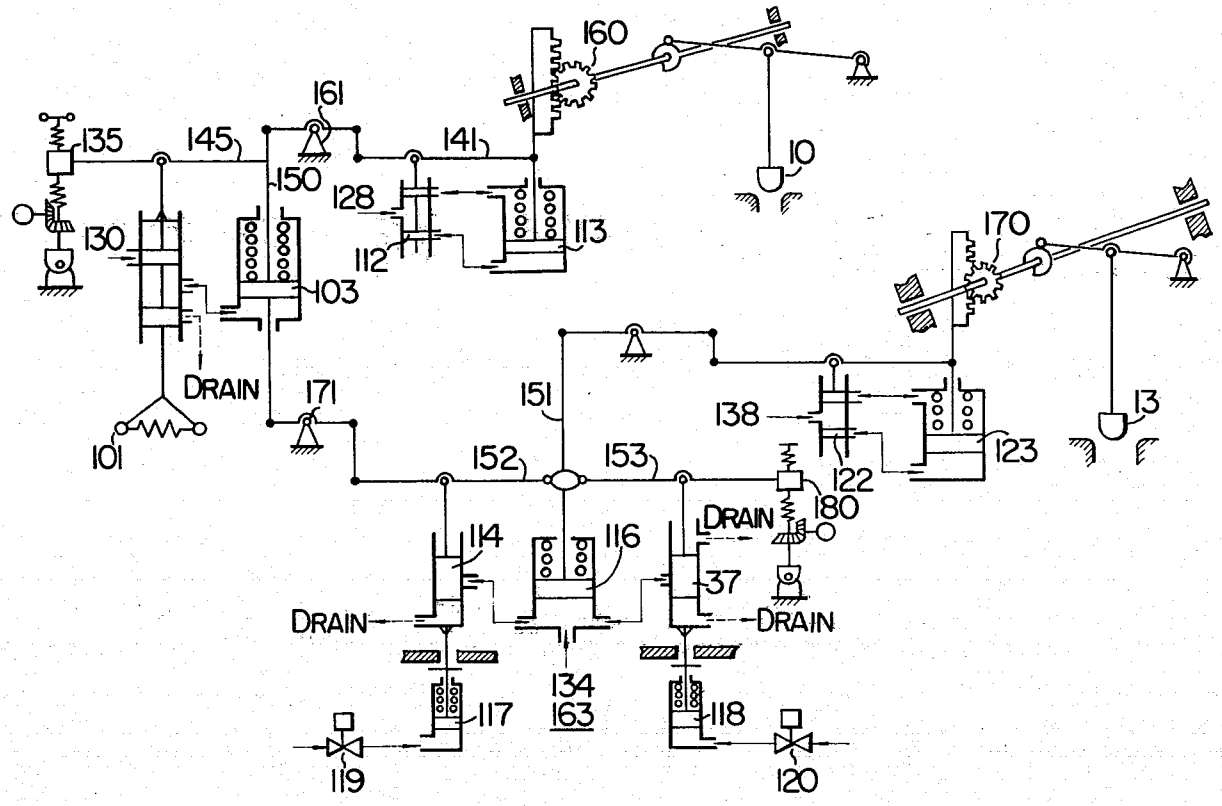

As a controlling device for use in a composite plant including a gas turbine and a steam turbine, mechanical type controlling devices will be referred to, in conjunction with FIGS. 4 and 5, which is unlike the controlling devices shown in FIGS. 2 and 3.

In FIGS. 4 and 5, there are shown only the regulating valve and steam injection valve in the steam turbine which are directly related to the present invention, with the steam turbine, gas turbine and waste heat boiler being not shown for simplification purposes.

Referring to FIG. 4, the steam regulating valve 10 and steam injection valve 13 are connected, through the intermediary of drive mechanisms 160, 170 each consisting of a rack and pinion, with servo-motors 113 and 123, respectively. The feeding and discharging of pressure oil 128, 138 to and from the servo-motors 113 and 123 are controlled by servo-motor pilot valves 112 and 122, respectively.

A high pressure preference mechanism 133 is composed of a regulating valve relay piston 106, to which pressure oil 124 is fed; pilot valves 104 and 105 for controlling pressure oil in the regulating valve relay piston 106, which are respectively provided on the speed controlling side and pressure controlling side of the regulating valve relay piston 106; levers 142 and 143 for engaging the pilot valves 104 and 105 with the regulating valve relay piston 106, respectively; a speed lock piston 107 operating the pilot valve 104 engaging the lever 142; a pressure lock piston 108 operating the pilot valve 105 engaging the lever 143; and electromagnetic valves 109 and 110 controlling the feeding of operating oil to the speed lock piston 107 and the pressure lock piston 108. The servo-motor 113 operating the regulating valve 10 and the servo-motor pilot valve 112 are connected, through the intermediary of a lever 141, with the regulating valve relay piston 106, so that the regulating valve 10 may be operated by the actuation of the regulating valve relay piston 106. The lever 141 engages the regulating valve relay piston 106 as well as engages the levers 142 and 143. Likewise, a low pressure preference mechanism 163 is composed of a steam injection valve relay piston 116, to which pressure oil 134 is fed; pilot valves 114 and 115 controlling pressure oil in the steam injection valve piston 116 and provided on the speed controlling side and the pressure controlling side of the steam injection valve relay piston 116, respectively; levers 152 and 153 engaging the pilot valves 114 and 115 with the steam injection valve relay piston 116; a speed lock piston 117 operating the pilot valve 114; a pressure lock piston 118 operating the pilot valve 115; and electromagnetic valves 119 and 120 for controlling the feeding of operating oil to the pressure lock piston 118, respectively. The servo-motor 123 operating the steam injection valve 13 and the servo-motor pilot valve 122 are connected, through the intermediary of a lever 151, with the steam injection valve relay piston 116, so that the steam injection valve 13 may be operated by the operation of the steam injection valve relay piston 116. The lever 151 engages the steam injection valve relay piston 116 as well as engages the levers 152 and 153.

A governor 101 is connected with a governor pilot 102. The governor pilot 102 controls the feeding and discharging of pressure oil 130 to and from a speed relay piston 103, in association with motion of the governor 101. The governor pilot 102 is connected to a lever 145, which in turn is connected at its one end with a synchronous device 135 and connected at the other end with a rod 150 of the speed relay piston 103. The rod 150 has the top end engaging by way of a fulcrum 161 with the lever 142 connected with the regulating valve relay piston 106, and the lower end engaging by way of a fulcrum 171 with the lever 152 connected with the steam injection valve relay piston 116.

In the valve controlling device described, the control for a speed change and a pressure change is effected, as follows. For example, if a turbine speed is increased, then pressure oil in the speed relay piston 103 is discharged due to signals from the governor 101, thereby rendering the rod 150 inoperative. The downward motion of the rod 150 is converted into the upward motion of the lever 142 with the aid of the fulcrum 161, and at the same time, the piston of the pilot valve 104 is moved upwards. On the other hand, if pressure of the high pressure steam 126 introduced into the high pressure turbine is also increased, a high pressure bellows 111 will be actuated to urge the lever 143 upwards, and resultantly, the piston of the pilot 105 will be moved upwards. A control oil pressure 124 in the regulating valve relay piston 106 is controlled by either of the pilot valves 104 and 105 which is larger in displacement of the piston. In other words, the control oil pressure is controlled by a signal larger in a relative displacement. Consequently, the regulating valve relay piston 106 is actuated by the signal larger in displacement, thereby adjusting by way of the lever 141 and servo-motor pilot valve 112 the feeding or discharging of pressure oil to or from the servo-motor 113, whereby the opening or closing of the regulating valve 10 is controlled. In the event that a turbine speed is abruptly increased due to load interruption caused when the regulating valve is in a controlled condition by the pressure signals, then a speed displacement becomes larger than the pressure displacement, and thus, the regulating valve 101 will be controlled by the speed signals. In case of the steam injection valve 13, a speed signal is transmitted by way of the rod 150 of the speed relay piston 103, and a pressure signal is transmitted from the low steam pressure 127 leading to the low pressure turbine by way of the low pressure bellow 121. The other mechanism is quite the same as that of the regulating valve.

The case where a valve control is effected by the use of a pressure signal only or by the use of a speed signal only will be referred to, by an example of control for the regulating valve.

In case of a speed control being effected independently, for example if the steam pressure does not reach a given level when in the starting, then the electromagnetic valve 110 is opened beforehand to cause pressure oil to flow into the pressure lock piston 108, so that the sleeve of the pilot valve 105 will be urged upwards, whereby a speed signal is usually preferentially used for controlling the regulating valve relay piston 106, and hence for controlling the regulating valve 10, even if a pressure signal fluctuates to some extent.

In case of a pressure control being effected independently, since a speed becomes constant in the rated operation, the electromagnetic valve 109 is opened to cause pressure oil to flow into the pressure lock piston 107, so that the sleeve of the pilot valve 104 will be forced upwards, whereby a pressure signal is preferentially applied for controlling the regulating valve relay piston 106, and hence for controlling the regulating valve 10.

According to the present invention, control valves for controlling steam to be fed to the high pressure turbine and the low pressure turbine of a steam turbine in a composite plant including a steam turbine and a gas turbine are controlled by both the turbine speed signal and the steam pressure signal. This ensures control for a steam turbine in response to change in a steam condition.

A controlling device for use in a composite plant shown in FIG. 5 is substantially the same in construction as the controlling device shown in FIG. 4, with the exception that there are omitted the regulating valve controlling preference mechanism for use in operating the regulating valve 10 and an auxiliary mechanism for use in operating the preference mechanism. Either in this embodiment, a quantity of steam to be fed to the steam turbine from the waste heat boiler is adjusted by controlling the steam injection valve, with the assurance of controlling the steam turbine in the composite plant.

What is claimed is:

1. In a composite plant including a steam turbine having a high pressure portion and a low pressure portion, a condenser for converting steam which has passed through said turbine into water, a gas turbine, a waste heat boiler producing a steam serving as an operating fluid for said steam turbine by the use of exhaust gas from said gas turbine as a heat source, a first heat exchanger producing high pressure steam and a second heat exchanger producing low pressure steam, said first and second heat exchangers being provided in said waste heat boiler, pipe lines for feeding condensation from said condenser in parallel to said first and second heat exchangers, a first steam passage through which the steam from said first heat exchanger is fed to the high pressure portion of the steam turbine, a second steam passage through which steam from said second heat exchanger is fed to the low pressure portion of the steam turbine and a third steam passage through which steam from said high pressure portion of the steam turbine is fed to the low pressure portion of the steam turbine; a device for controlling a steam turbine comprising;

a first steam valve provided on said first steam passage connecting said first heat exchanger to the high pressure portion of steam turbine and controlling a flow rate of steam;

a second steam valve provided on said second steam passage connecting said second heat exchanger to the low pressure portion of steam turbine and controlling a flow rate of steam;

A detecting device for detecting a condition of steam to be fed from said second heat exchanger to said second steam valve through said second steam passage;

a speed detecting device for detecting the r.p.m. of the steam turbine; and, a selecting device for selecting from signals detected by said condition and speed detecting devices a signal more important so as to operate the second steam valve in the controlling of the composite plant.

2. A device for controlling a steam turbine for use in a composite plant including steam turbine and a gas turbine, as defined in claim 1 further comprising; another detecting device for detecting a condition of steam to be fed to said first valve;

and another selecting device for selecting from the signals detected by said other detecting device and said speed detecting device a signal more important so as to operate the first steam valve in the controlling of the composite plant.

3. In a composite plant including a steam turbine having a high pressure portion and a low pressure portion, a condenser for converting steam which has passed through said turbine into water, a gas turbine, a waste heat boiler producing a steam serving as an operating fluid for said steam turbine by the use of exhaust gas from said gas turbine as a heat source, a first heat exchanger producing high pressure steam and a second heat exchanger producing low pressure steam, said first and second heat exchangers being provided in said waste heat boiler, pipe lines feeding condensation from said condenser in parallel to said first and second heat exchangers, a first steam passage through which the steam from said first heat exchanger is fed to the high pressure portion of the steam turbine, a second steam passage through which steam from said second heat exchanger is fed to the low pressure portion of the steam turbine and a third steam passage through which steam from said high pressure portion of the steam turbine is fed to the low pressure portion of the steam turbine; a device for controlling a steam turbine comprising;

a first steam valve provided on said first steam passage and controlling a flow rate of steam;

a second steam valve provided on said second steam passage and controlling a flow rate of steam;

a speed detecting device for detecting the r.p.m. of the steam turbine;

a pressure detecting device for detecting pressure of steam flowing from said second heat exchanger into said second steam valve through said second steam passage;

first computing means comparing a speed signal detected by said speed detecting device with a set value;

second computing means comparing a pressure signal detected by said pressure detecting device with set value;

a selecting device for preferentially selecting between output signals produced from said first and second computing means an output signal more largely influencing said second steam valve in the direction tending to close same; and an actuating device for actuating said second steam valve according to the output signal from said selecting device.

4. A device for controlling a steam turbine in a composite plant including a steam turbine and a gas turbine, as defined in claim 3, further comprising;

another pressure detecting device for detecting pressure of steam introduced from said first heat exchanger in said first steam valve through said first steam passage;

third computing means comparing a pressure signal detected by said another pressure detecting device with a set value;

another selecting device preferentially selecting from the output signals obtained from said first and third computing means an output signal more largely influencing said first steam valve in the direction tending to close same; and another actuating device operating said first steam valve according to an output signal selected by said selecting device.

5. A device for controlling a steam turbine in a composite plant including a steam turbine and a gas turbine, as defined in claim 3, further comprising;

valve opening detecting means for detecting a degree of opening of said second steam valve; and fourth computing means comparing a signal detected by said valve opening detecting means with an output signal selected by said selecting device, and feeding as an input signal a deviation signal between both signals to the actuating device.

6. A device for controlling a steam turbine in a composite plant including a steam turbine and a gas turbine, as defined in claim 4, further comprising;

valve opening detecting means for detecting a degree of opening of said second steam valve;

another valve opening detecting means for detecting a degree of opening of said first steam valve;

a fourth computing means comparing a signal detected by the firstly-mentioned valve opening detecting means with an output signal selected by the selecting device, and feeding a deviation signal obtained from said both signals to the actuating device as an input signal; and, a fifth computing means comparing a signal detected by the secondly-mentioned valve opening detecting means with an output signal from the other selecting device, and feeding as an input signal a deviation signal obtained from said both signals to the other actuating device.

7. In a composite plant including a steam turbine having a high pressure portion and a low pressure portion, a condenser for converting steam which has passed through said turbine into water, a gas turbine, a waste heat boiler producing steam being an operating fluid for the steam turbine by the use of exhaust gas from said gas turbine as a heat source, a first heat exchanger producing high pressure steam, a second heat exchanger producing low pressure steam, said first and second heat exchangers being provided in said waste heat boiler, pipe lines for feeding condensation from said condenser in parallel to said first and second heat exchangers, a first piping for feeding steam from said first heat exchanger to the high pressure portion of the steam turbine, a second piping for feeding steam from said second heat exhanger to the low pressure portion of the steam turbine and a third piping for feeding steam from said high pressure portion of the steam turbine to said low pressure portion of the steam turbine; a device for controlling a steam turbine comprising;

a first steam valve provided on said first piping and controlling a flow rate of steam;

a second steam provided on said second piping and controlling a flow rate of steam;

a first and second hydraulic devices operating said first steam valve and second steam valve, respectively;

a first relay piston device connected with said second hydraulic device by first lever means;

second and third lever means provided in said first relay piston device and connected with said first lever means;

a pair of pilot valves connected with the second and third lever means and governing discharge of pressure oil fed to said first relay piston device;

a governor controlling a speed of the steam turbine;

a pressure responsive device provided on said second piping for detecting steam pressure flowing into the second steam valve and operating one of the pilot valves;

a speed relay piston device actuated by said governor and operating another pilot valve;

said second lever means being connected with the speed relay piston device, and said third lever means being connected with the pressure responsive device.

8.

A device for controlling a steam turbine in a composite plant including a steam turbine and a gas turbine, as defined in claim 7, further comprising;

a second relay piston device connected with said first hydraulic device by a fourth lever means;

a fifth and sixth lever means provided in said second relay piston device and connected with said forth lever means;

a pair of other pilot valves connected with said fifth and sixth lever means, respectively, and governing discharge of pressure oil fed to said second relay piston device; said one of the other pilot valves is operated by another pressure responsive device, and another of other pilot valves is operated by the speed relay device;

another pressure responsive device provided on said first piping for detecting steam pressure flowing into the first steam valve and operating the one of the another pilot valves;

said fifth lever means being connected with the speed relay piston device, and said sixth lever means being connected with the another pressure responsive device.

* * * * *